US008119944B2

(12) United States Patent
Kikuchi et al.

(10) Patent No.: US 8,119,944 B2
(45) Date of Patent: Feb. 21, 2012

(54) ELECTRONIC DEVICE

(75) Inventors: Hidetake Kikuchi, Fukuoka (JP); Takashi Kawamura, Fukuoka (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 336 days.

(21) Appl. No.: 12/428,754

(22) Filed: Apr. 23, 2009

(65) Prior Publication Data

US 2009/0266689 A1 Oct. 29, 2009

(30) Foreign Application Priority Data

Apr. 25, 2008 (JP) ..... P2008-116372

(51) Int. Cl.
*H01H 9/02* (2006.01)

(52) U.S. Cl. ..... 200/305; 200/406; 200/516

(58) Field of Classification Search ..... 200/406, 200/516, 304, 305
See application file for complete search history.

(56) References Cited

U.S. PATENT DOCUMENTS 6,114,644 A * 9/2000 Nishikawa ..... 200/406
6,140,596 A * 10/2000 Tsay ..... 200/406
7,429,707 B2 * 9/2008 Yanai et al. ..... 200/1 B
7,525,059 B2 * 4/2009 Masuda et al. ..... 200/406
7,741,573 B2 * 6/2010 Masuda et al. ..... 200/406

FOREIGN PATENT DOCUMENTS

JP 01-175132 7/1989
JP 09-120740 5/1997
JP 9-120742 5/1997

OTHER PUBLICATIONS

Japances Office Action, Nov. 2009.

* cited by examiner

*Primary Examiner* — Xoung Chung Trans
(74) *Attorney, Agent, or Firm* — Whitham Curtis Christofferson & Cook, PC

(57) ABSTRACT

An electronic device adapted to be mounted on a circuit board is disclosed. A housing is made of an insulative material. The housing includes a first face adapted to oppose the circuit board, a second face and a third face which respectively intersect with the first face. A cover covers a part of the housing and is made of a conductive material. An earth contact member is made of a conductive material and integrally molded with the housing. The earth contact member has a first terminal extending from the first face to the second face and a second terminal disposed on the third face and being in contact with the cover. The first terminal is adapted to be soldered on an earth circuit on the circuit board.

6 Claims, 10 Drawing Sheets

ELECTRONIC DEVICE

BACKGROUND

The present invention relates to an electronic device including a switch-type electronic device such as a push switch adapted to be mounted on a printed circuit board to be disposed in various kinds of electronic apparatuses.

There are known various kinds of switch-type electronic devices such as a push switch mounted on a printed circuit board of an electronic apparatus (see, Japanese Patent Publication No. 9-120742 A).

Such a push switch requires a countermeasure for preventing a static electricity carried by a hand or a finger of an operator from supplying a circuit of the electronic apparatus through an operating member of the push switch. As the countermeasure, an earth terminal for releasing the static electricity to an earth circuit of the printed circuit board is ordinarily provided in an electric conductor in the vicinity of the operating member of the electronic apparatus.

As the conventional switch-type electronic device to which the countermeasure for the static electricity is applied, one example will be described by referring to FIGS. 10 to 14.

As shown in FIG. 11, a push switch 101 comprises a box-shaped housing 102 formed with a space 103 an upper side of which is opened. A circular dome-shaped movable contact 104 made of an elastic thin metal plate is disposed on an inner bottom part of the space 103. A central lower face of the movable contact 104 opposes fixed contacts 105*a* and 105*b* each of which is made of the thin metal plate and fixed on the housing 102 by insertion molding. A protective film 106 is disposed on an upper part of the movable contact 104, and an operating member 107 made of resin is disposed on the protective film 106. A cover 108 made of metal is attached to the housing 102 so as to cover the operating member 107 from above.

The housing 102 includes engaging projections 109 respectively protruding outward along a lower face 102*c* of the housing 102 at right and left corners of front and rear side faces 102*a* and 102*b* of the housing 102. Further, in the other end sides, lead terminals 105A and 105B are provided that are directed outward the right and left side faces 102*d* and 102*d* of the housing 102 from the lower face 102*c*.

The operating member 107 includes a pressed part 107*a* and an elastic actuator 107*b*. The pressed part 107*a* extends from a front side face 102*a* of the housing 102 through an opening 111 formed in the front side face 102*a*.

The cover 108 is located on an upper face of the housing 102. The cover 108 includes an upper plate 108*a* having an inclined piece obliquely extended from a center part thereof toward the inside of the space 103. A pair of legs 108*a* are extended downward from a front edge of the upper plate 108*a* along the front side face 102*a* of the housing 102. A pair of legs 108*b* are extended downward from a rear edge of the upper plate 108*a* along a rear side face 102*b*. At a lower end of each of the legs 108*b*, an engagement piece 108*c* is formed so as to oppose a lower face of an associated one of the engagement projections 109. The engagement pieces 108*c* are bent and caulked so that the cover 108 is retained on the housing 102.

The pair of right and left legs 108*b* provided in the front side face 102*a* of the housing 102 are separated from each other sufficiently so that at least the operating member 107*b* of the operating member 107 can be described therebetween.

At the center of a rear end of the upper face plate 108*a*, an earth terminal piece 112 is provided and extended downward along the rear side face 102*b* of the housing 102 from the rear end of the upper face plate 108*a*. The lower face of the earth terminal piece 112 is substantially flush with the bottom face of the housing 102 and the lower part thereof is bent to be substantially L-shaped.

In the conventional push switch 101, as shown in FIG. 14, the operating member 107 is projected forward (leftward in FIG. 14) from a printed circuit board 115 on which the push switch is mounted and the lead terminals 105A and 105B are respectively soldered to an associated wiring pattern so that the push switch 101 is mounted on the printed circuit board. Further, when the push switch is mounted on the printed circuit board, the earth terminal piece 112 of the cover 108 is also soldered to a corresponding wiring part of an earth circuit.

In the push switch 101 mounted on the printed circuit board 115 in such a way, under a state that the operating member 107 is arranged at a position shown by a dashed chain line in FIG. 11, when a front end of the pressed part 107*a* is horizontally pressed rearward, the operating member 107 horizontally moves on the protecting film 106 along the upper face of the housing 102 and the end of the operating member 107*b* is directed downward by the inclined piece 110 to apply a push down force to the movable contact 104 located at a lower part.

When the push down force exceeds a prescribed level, as shown by a solid line of FIG. 11, the lower face of the central part of the movable contact 104 moves downward and comes into contact with the fixed contacts 105*a* and 105*b* to obtain a conductive state (turn-on state) in which the lead terminals 105A and 105B are short-circuited through the movable contact 104. As an amount of pushing operation of the operating member 107, when the rear face of the pressed part 107*a* abuts against the front side face 102*a* of the housing 102, a further pushing operation is regulated.

When the operating force of the pressed part 107*a* is released, the movable contact 104 is self-restored to an original attitude to push up the operating member 107*b* and the end of the operating member 107*b* is guided by the inclined piece 110, so that the operating member 107 is pushed back forward to the position shown by the dashed chain line in FIG. 11 to return to an original non-conductive state (turn-off state).

When the finger of a person who operates the push switch 101 mounted on the printed circuit board 115 of an electric apparatus in use presses the front end of the pressed part 107*a*, even if a static electricity carried by the body of the operator is supplied to the operating member 107 from the finger, the static electricity is supplied to an earth circuit of the printed circuit board 115 through the cover 108 and the earth terminal piece 112.

However, as in the conventional push switch, in a structure that the earth terminal piece 112 is extended downward along the rear side face 102*b* of the housing 102 from the rear end of the upper face plate 108*a* and the earth terminal piece 112 is soldered to the wiring part of the earth circuit of the printed circuit board 115 to avoid the static electricity problem, when the earth terminal piece 112 is soldered, a flux may possibly enter a clearance S1 (see FIG. 14) between the housing 102 and the earth terminal piece 112 due to a capillary phenomenon. In these days, downsizing of such a push switch is strongly demanded, and the width of each side face of the housing 112 is less than 3 mm. In such a size, the above-described capillary phenomenon becomes remarkable, and the movement of the flux is hardly controlled during soldering.

As a countermeasure for preventing the entry of the flux, a width of the clearance S1 may be increased to eliminate the capillary phenomenon. However, contrary to the above-described demand, the size of the push switch is increased in accordance with the increase of the width of the clearance S1. Further, since the end of the earth terminal piece 112 is bent outward at right angles, the size is further enlarged by such an amount S2 that the end of the earth terminal piece 112 is projected from the cover 108.

Since the earth terminal piece 112 and the lead terminals 105A, 105*b* are soldered to the circuit board respectively, they should be made flush with each other. However, since the earth terminal piece 112 is provided on the cover 108, an accuracy of height of the earth terminal piece 112 to the circuit board depends on an accuracy of assembling the cover 108 to the housing 102. Thus, a height difference with respect to the circuit board among the earth terminal piece 112 and the lead terminals 105A, 105B is hardly to be avoided. In other words, it is difficult to obtain the coplanarity among the earth terminal piece 112 and the lead terminals 105A, 105B, especially in a case where a thin metal mask for soldering is used to attain the height reduction.

SUMMARY

It is therefore one advantageous aspect of the present invention to provide an electronic device capable of avoiding the above-described flux movement during soldering, while realizing a compact and thin structure.

According to one aspect of the invention, there is provided an electronic device adapted to be mounted on a circuit board, comprising:

a housing, made of an insulative material and having a first face adapted to oppose the circuit board, a second face and a third face respectively intersecting with the first face;

a cover, covering a part of the housing and made of a conductive material; and an earth contact member, made of a conductive material and integrally molded with the housing, the earth contact member having:

a first terminal, extending from the first face to the second face, and adapted to be soldered on an earth circuit on the circuit board; and a second terminal, disposed on the third face and being in contact with the cover.

The electronic device may be configured such that: the third face of the housing is formed with a projection; the cover has a first part disposed in a side opposite to the first face of the housing, a second part extending from the first part, and a third part extending from the second part and engaged with the projection; and the second part of the cover is in contact with the second terminal of the earth contact member.

According to one aspect of the invention, there is provided a switch-type electronic device adapted to be mounted on a circuit board, comprising:

a housing, made of an insulative material and having a first face adapted to oppose the circuit board, a second face and a third face respectively intersecting with the first face;

a cover, covering a part of the housing and made of a conductive material;

an operating member, having a first part disposed in the housing and a second part disposed outside the housing and adapted to be operated by a user;

a first contact member, disposed in the housing and made of a conductive member, the first contact member configured to be actuated by the first part of the operating member when the second part of the operating member is operated by the user;

a plurality of second contact members, each of which is made of a conductive material and integrally molded with the housing, each of which is configured to switchingly comes in contact with the first contact member when the first contact member is actuated by the operating member, and each of which has a terminal extending from the first face to one of the second face and the third face; and an earth contact member, made of a conductive material and integrally molded with the housing, the earth contact member having;

a first terminal, extending from the first face to the second face, and adapted to be soldered on an earth circuit on the circuit board; and a second terminal, disposed on the third face and being in contact with the cover.

The switch-type electronic device may be configured such that:

the third face of the housing is formed with a projection; the cover has a first part disposed in a side opposite to the first face of the housing, a second part extending from the first part, and a third part extending from the second part and engaged with the projection; and the second part of the cover is in contact with the second terminal of the earth contact member.

According to one aspect of the invention, there is provided a push switch adapted to be mounted on a circuit board, comprising:

a housing, made of an insulative material and having a first face adapted to oppose the circuit board, a second face and a third face respectively intersecting with the first face;

a cover, covering a part of the housing and made of a conductive material;

an operating member, having a first part disposed in the housing and a second part disposed outside the housing and adapted to be operated by a user;

a movable contact member, disposed in the housing and made of a conductive member, the movable contact member configured to be actuated by the first part the operating member when the second part of the operating member is pushed by the user;

a first fixed contact member, made of a conductive material and integrally molded with the housing, the first fixed contact member having a terminal extending from the first face to one of the second face and the third face;

a second fixed contact member, made of a conductive material and integrally molded with the housing, the second fixed contact member having a terminal extending from the first face to one of the second face and the third face, and configured to be electrically connected to the first fixed contact member by way of the movable contact member when the movable contact member is actuated by the operating member; and an earth contact member, made of a conductive material and integrally molded with the housing, the earth contact member having;

a first terminal, extending from the first face to the second face, and adapted to be soldered on an earth circuit on the circuit board; and a second terminal, disposed on the third face and being in contact with the cover.

The push switch may be configured such that: the third face of the housing is formed with a projection; the cover has a first part disposed in a side opposite to the first face of the housing, a second part extending from the first part, and a third part extending from the second part and engaged with the projection; and the second part of the cover is in contact with the second terminal of the earth contact member.

BRIEF DESCRIPTION OF THE DRAWINGS

FIG. 2 is a sectional view taken along a line II-II in FIG. 1 and showing a state that an operating member is pushed in.

DETAILED DESCRIPTION OF EXEMPLIFIED EMBODIMENTS

Exemplified embodiments of the invention are described below in detail with reference to the accompanying drawings.

Figure 1:
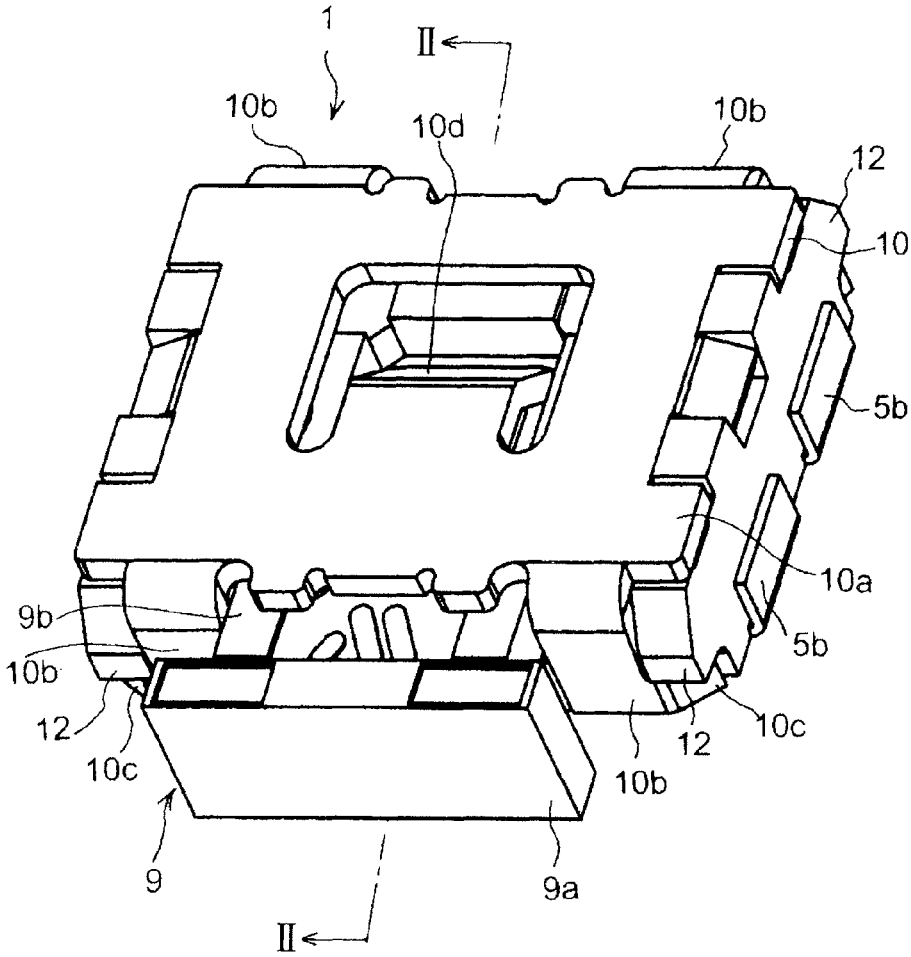
FIG. 1 is a perspective view showing a push switch according to one embodiment of the present invention.
Figure 2:
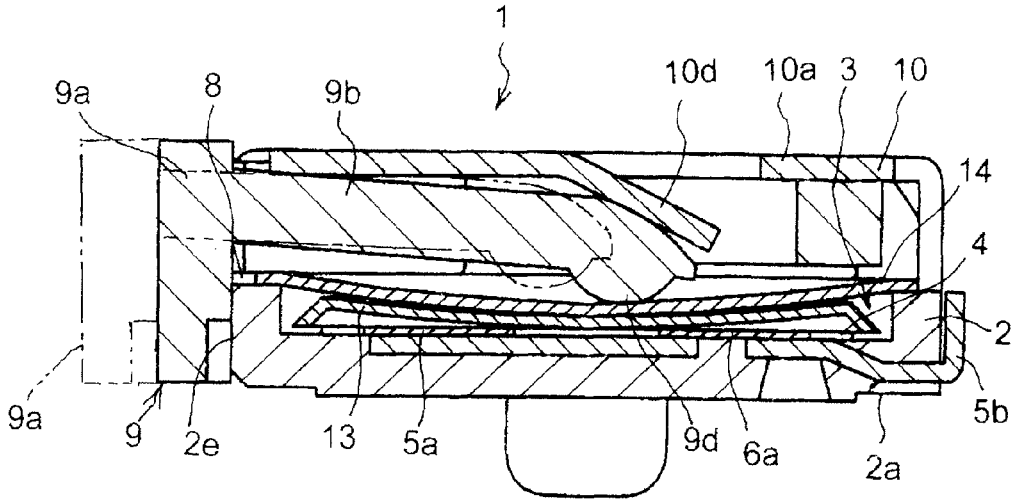
Figure 7:
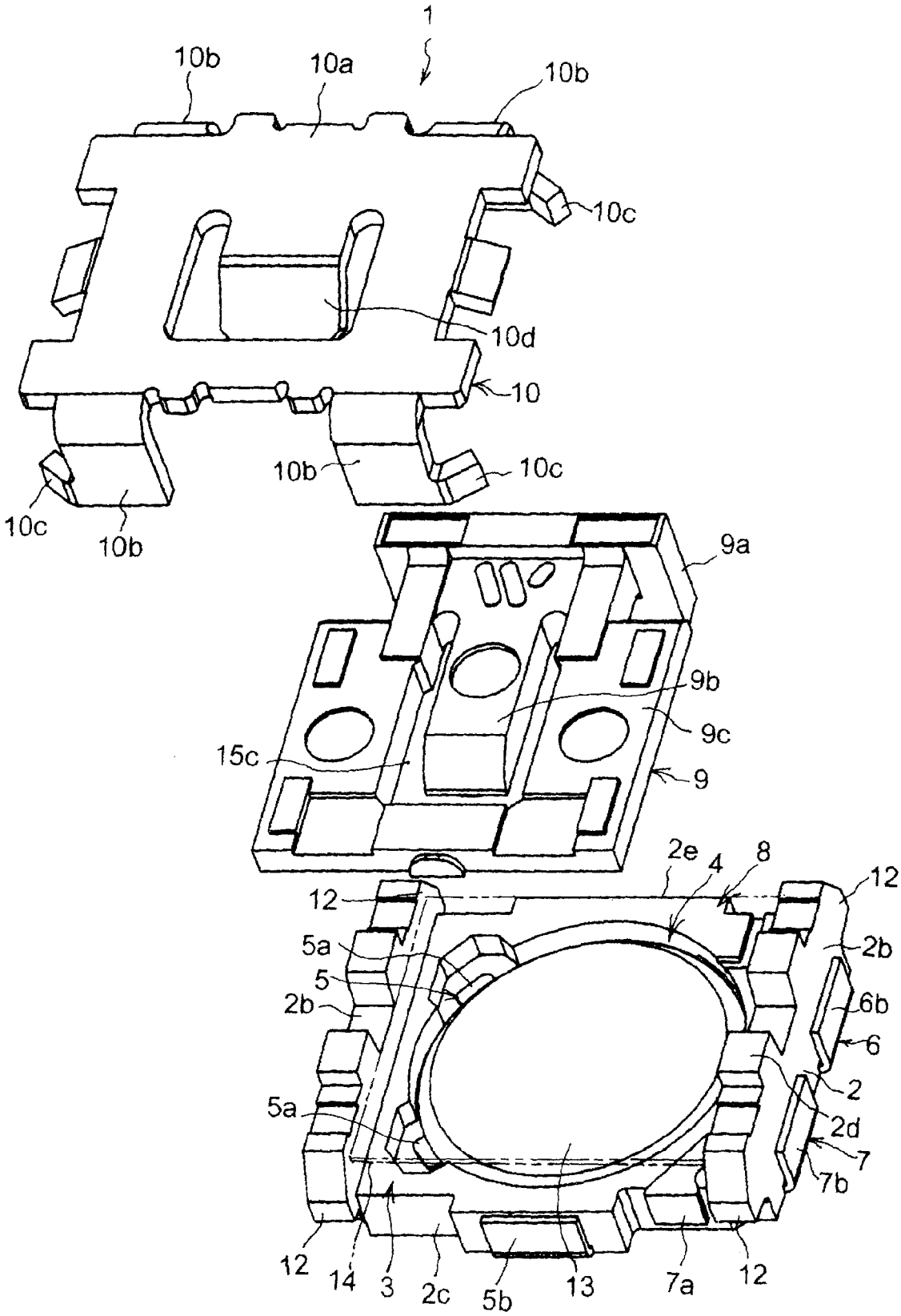
FIG. 7 is a perspective view of the push switch in a disassembled condition.
Figure 8:
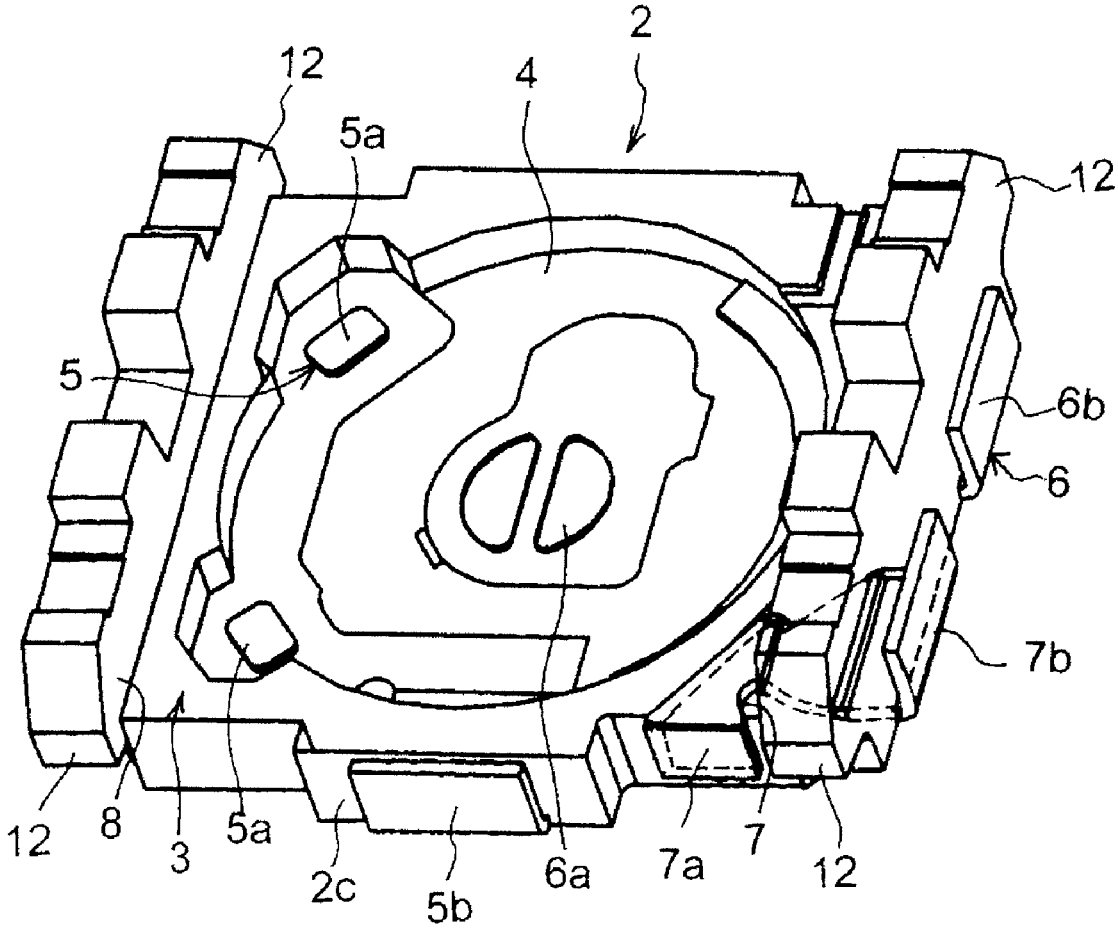
FIG. 8 is a perspective view showing a housing of the push switch.
Figure 9:
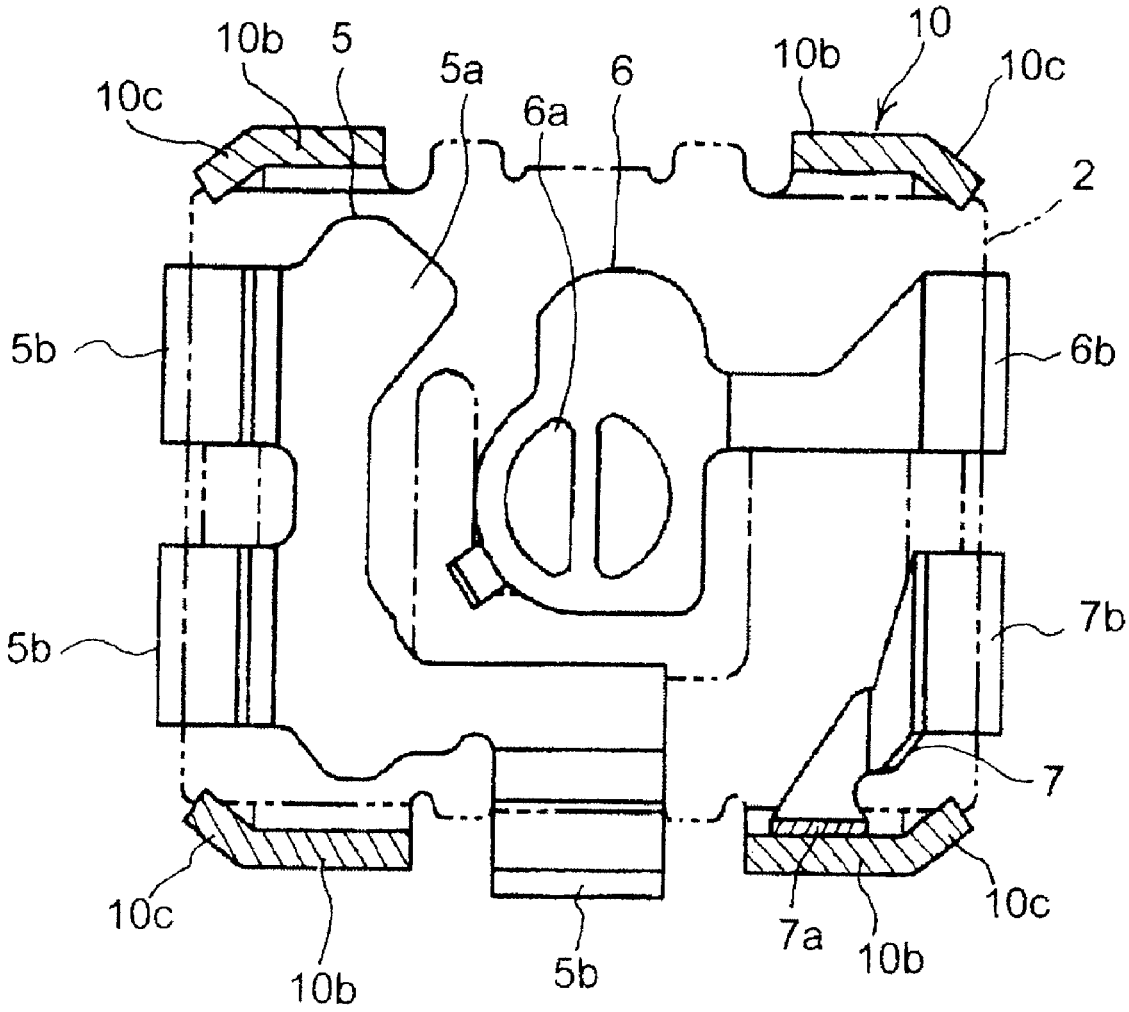
FIG. 9 is a schematic view showing an arrangement of contact members and a cover of the push switch.
Figure 10:
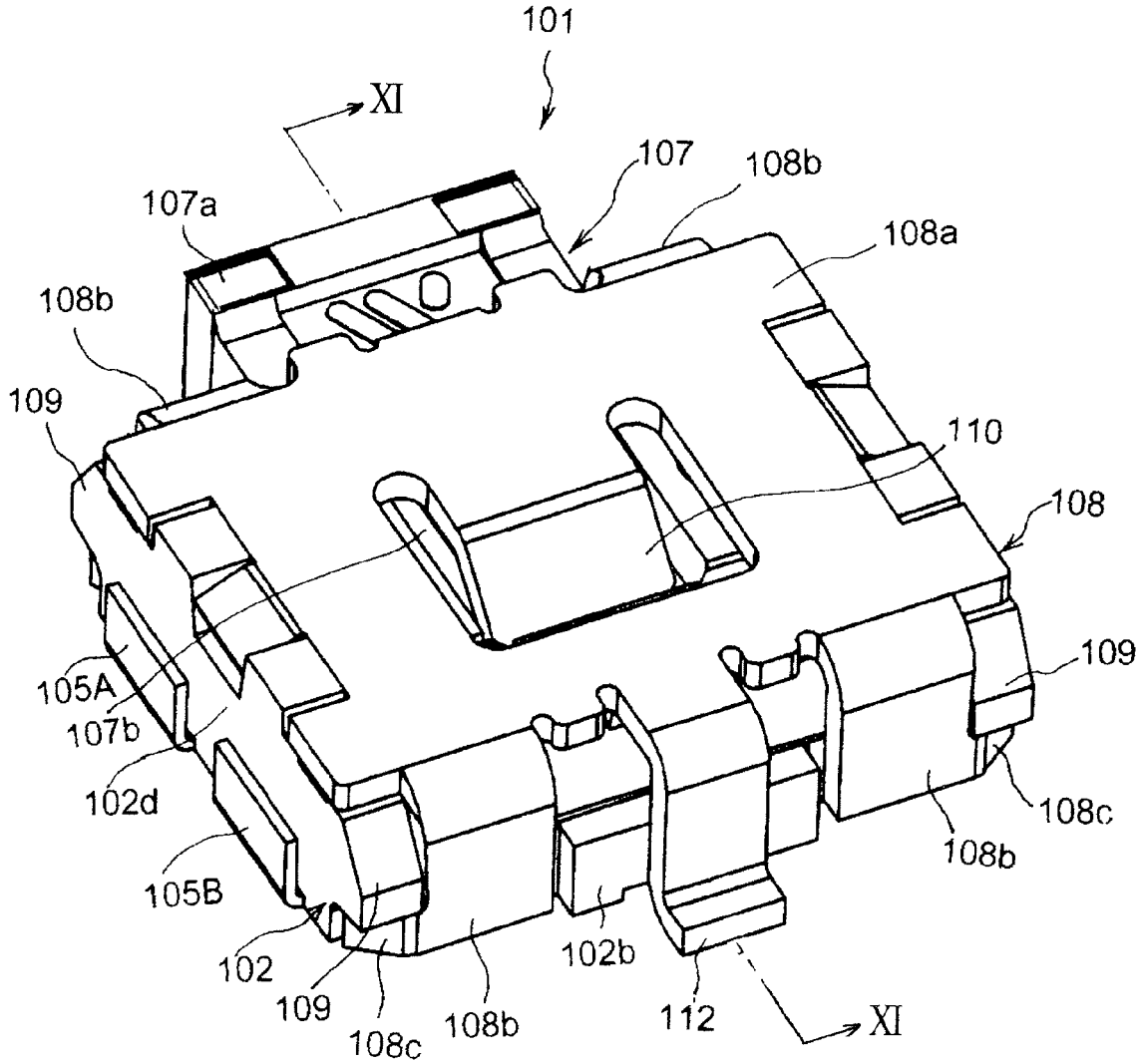
FIG. 10 is a perspective view of a conventional push switch.
Figure 11:
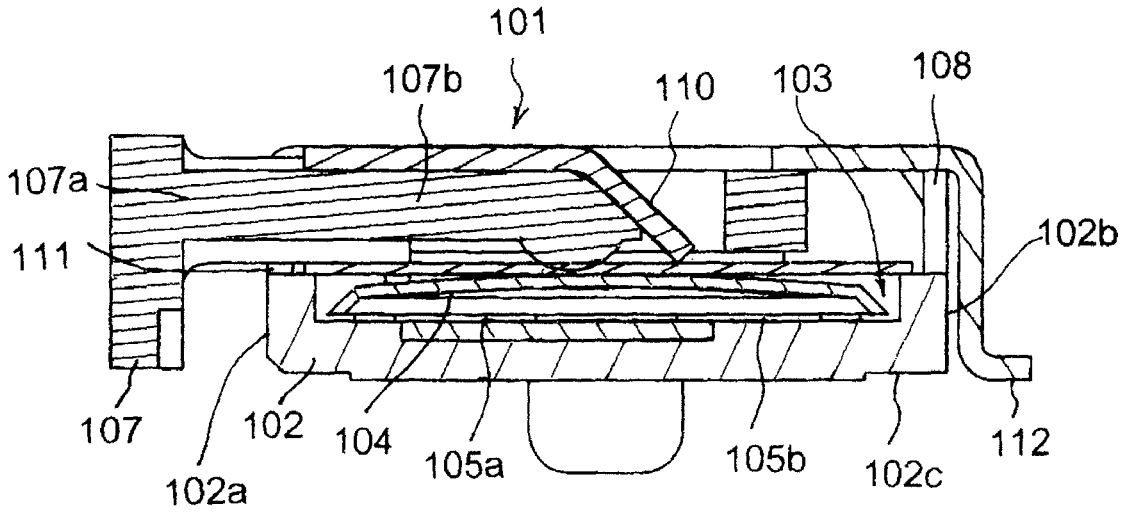
FIG. 11 is a sectional view taken along a line XI-XI of FIG. 10.
Figure 12:
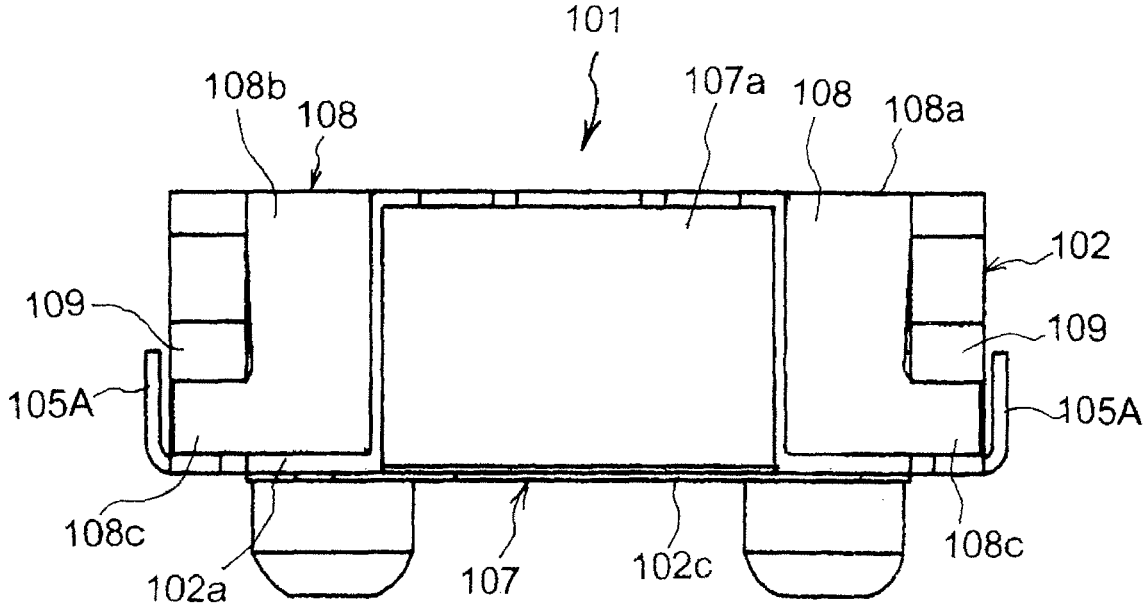
FIG. 12 is a front view of the conventional push switch.
Figure 13:
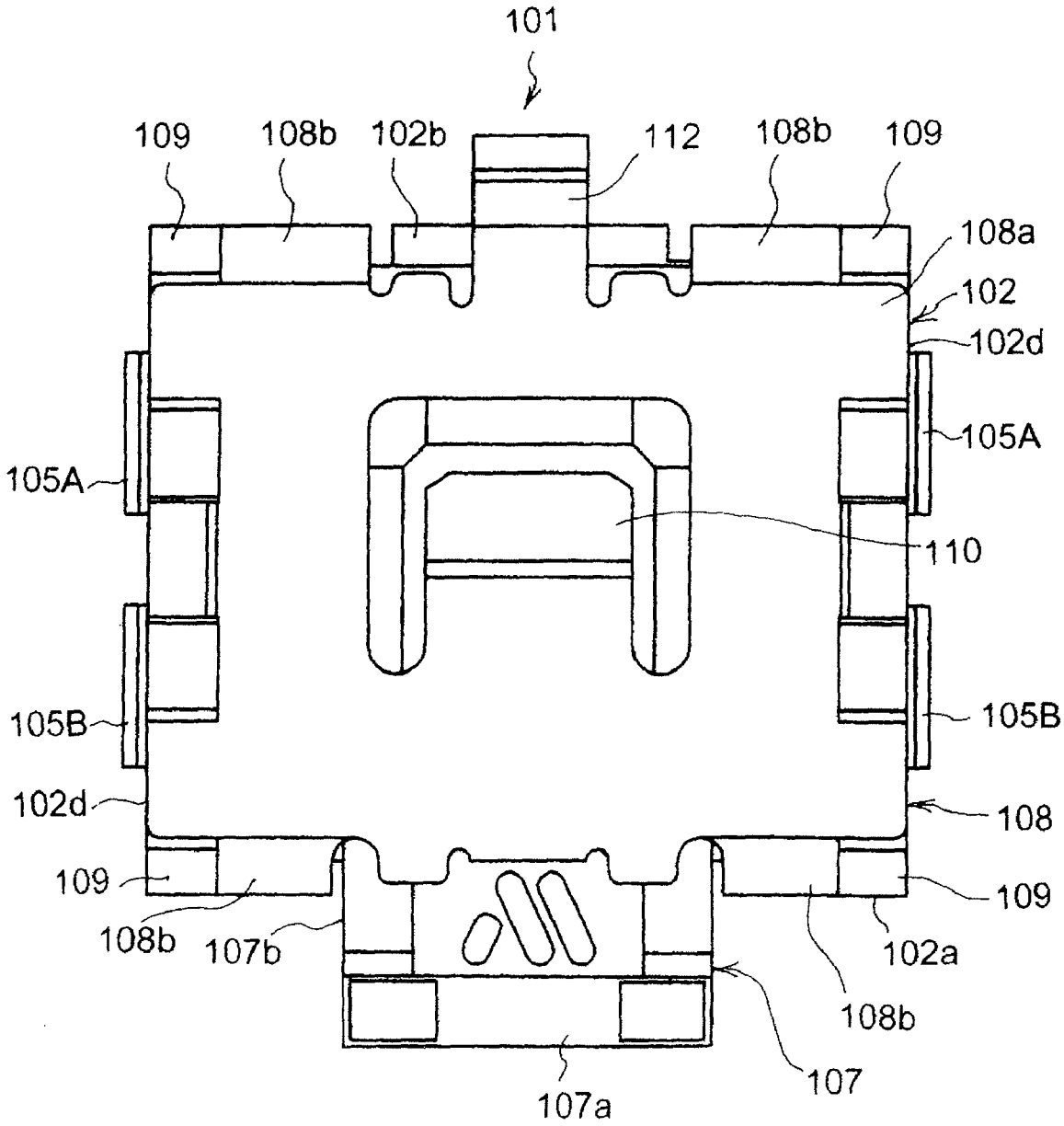
FIG. 13 is a plan view of the conventional push switch.
Figure 14:
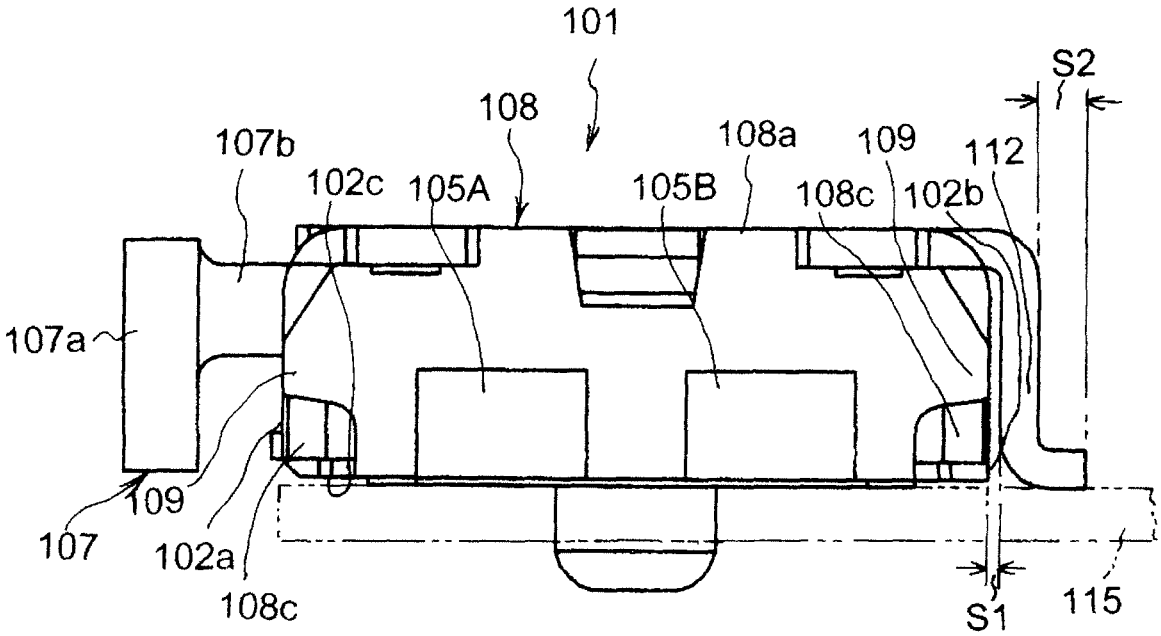
FIG. 14 is a side view of the conventional push switch.

As shown in FIGS. 1 to 9, a push switch 1 which is one example of a switch-type electronic device comprises a box-shaped housing 2 made of a resin material and formed with space 3 an upper side of which is opened shown in FIGS. 2, 7 and 8. A pair of first contact members 5 and 6 and a second contact member 7 are integrally embedded by an insert molding in an inner bottom part 4 of the space 3. The pair of first contact members 5 and 6 are made of a metal plate. The second contact member 7 is made of a metal plate. As well as the conventional push switch, the width of each side face of the housing 2 is less than 3 mm.

As shown in FIGS. 2, 7 and 8, a fixed contact 5*a* is provided on one end of the first contact member 5 and exposed at the inner bottom face 4 of the space 3. A lead terminal 5*b* is provided on the other end of the first contact member 5 and led out from a lower face 2*a* of the housing 2 so as to extend outward of one of opposite side faces 2*b* of the housing 2. A fixed contact 6*a* is provided on one end of the first contact member 6 and exposed at the inner bottom face 4 of the space 3. A lead terminal 6*b* is provided on the other end of the first contact member 6 and led out from the lower face 2*a* so as to extend outward of the other one of the opposite side faces 2*b* of the housing 2. The first contact member 5 is provided with further lead terminals 5*b* which are led out from the lower face 2*a* so as to extend outward of the rear side face 2*c* of the housing 2.

An external fixed terminal 7*a* is provided on one end of the second contact member 7 and exposed at a position on the rear side face 2*c* closer to one of the opposite side faces 2*b* (in FIGS. 7 to 9, the right side face) so as to extend downward from an upper face 2*d* of the housing 2 toward the lower face 2*a*. A lead terminal 7*b* is provided on the other end of the second contact member 7 and led out from the lower face 2*a* so as to extend outward of the one of the opposite side face 2*b* on which the lead terminal 6*b* is disposed.

A front side face 2*e* of the housing 2 is formed with an opening 8 communicating with the space 3. An operating member 9 includes a pressed part 9*a* and an actuator 9*b* (described later in detail). The operating member 9 is accommodated in the space 3 such that the pressed part 9*a* and a part of the actuator 9*b* extend outward through the opening 8. At both side end portions of each of the rear side face 2*c* and the front side face 2*e*, there are provided engagement projections 12 to which engagement pieces 10*c* of legs 10*b* provided on a cover 10 (described later in detail) are engaged by caulking.

A dome-shaped movable contact 13 made of a thin metal plate is disposed on above fixed contacts 5*a* and 6*a*. A lower face of a top portion of the dome-shaped movable contact 13 opposes the fixed contact 6*a* across a gap therebetween. An outer peripheral portion of the dome-shaped movable contact 13 is in contact with the fixed contact 5*a*.

A protecting sheet 14 made of an insulating resin sheet material such as polyamide resin is disposed above the movable contact 13. The peripheral edge part of the protecting sheet 14 is mounted on the upper face of the housing 2 and fixed by adhesive agent so as to cover the space 3 therewith to prevent dust or foreign materials from entering the conductive members disposed in the space 3.

As shown in FIG. 7, the operating member 9 is made of a resin and includes: the pressed part 9*a* which is always to be located outside the housing 2; the actuator 9*b* extended from the pressed part 9*a* toward inside the space 3; a slider 9*c* surrounding the actuator 9*b* across a gap 15*c* therebetween. The pressed part 9*a* has parts extended from a front end of the actuator 9*b* upward, downward, rightward and leftward.

Figure 3:
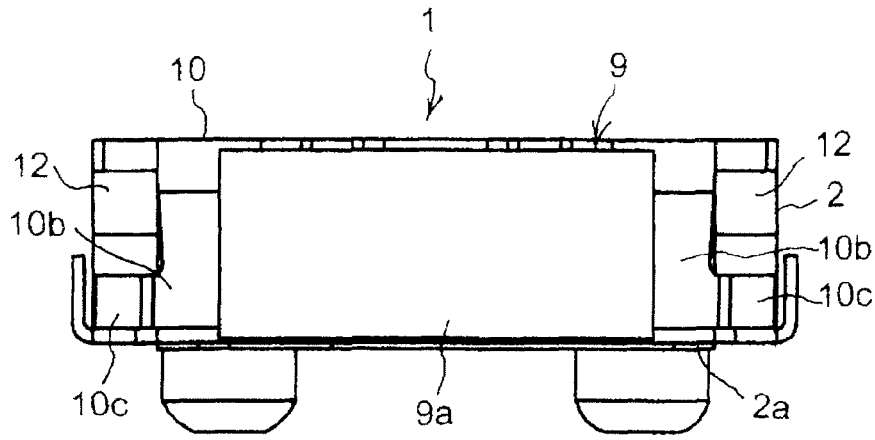
FIG. 3 is a front view of the push switch.
Figure 4:
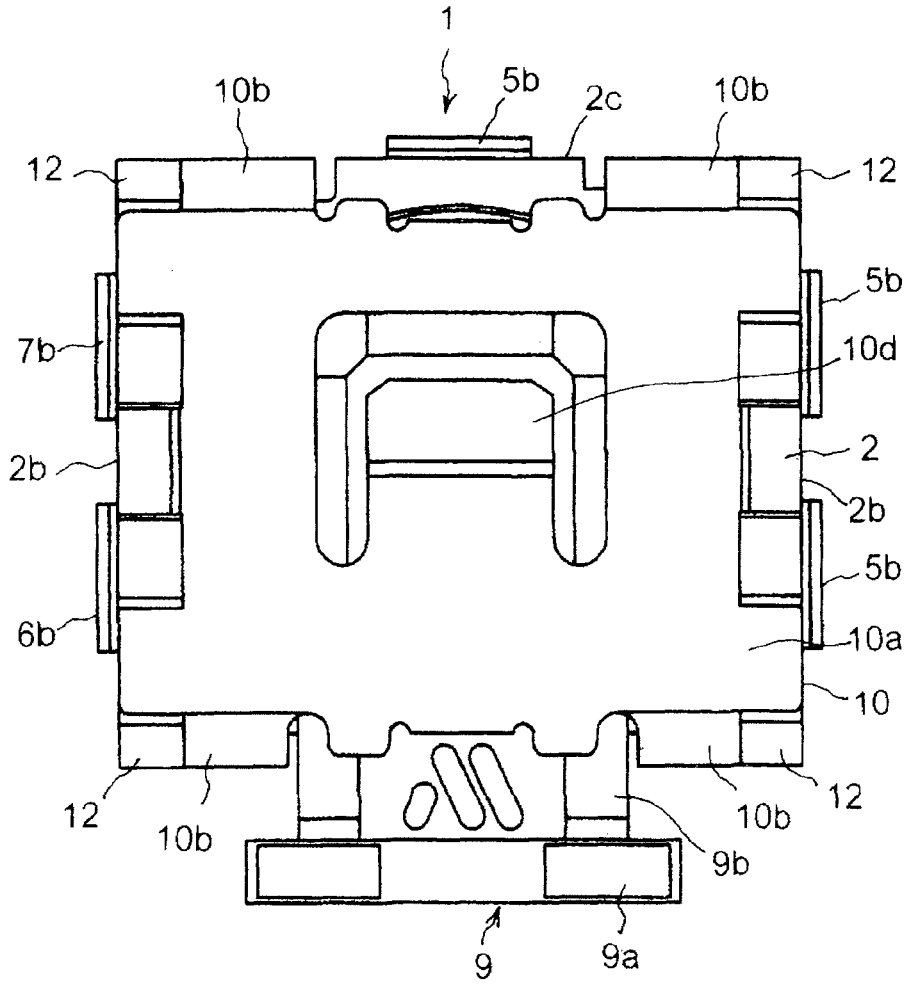
FIG. 4 is a plan view of the push switch.

The pressed part 9*a* serves as a face receiving an operation for pushing the operating member 9 from the outside of the housing 2. Further, the pressed part 9*a* serves to prevent the legs 10*b* of the cover 10 located both sides of the opening 8 from being deformed forward. A lateral width of the pressed part 9*a* is, as shown in FIG. 3, sufficiently greater than a width of each of the legs 10*b*. When the operating member 9 is pushed into the space 3 in the housing 2 and the turn-on state is established (described later in detail), a rear face of the pressed part 9*a* comes in contact with the legs 10*b* so that the pressed part 9*a* covers at least parts of the legs 10*b*, thereby preventing the legs 10*b* from being deformed forward. Alternatively, the rear face of the pressed part 9*a* may come in contact with the front side face 2*e* and may oppose the legs 2*b* across minute gaps therebetween.

The operating member 9 is disposed above the protective sheet 14 so that an abutment part 9*d* which is a free end of the actuator 9*b* opposes an upper face of the top part of the dome-shaped movable contact 13 across the protective sheet 14. The slider 9*c* is slidably disposed within the space 3.

The cover 10 is formed by punching and bending a metal plate. The cover 10 includes: a flat upper plate 10*a* attached to an upper part of the housing 2 so as to cover the space 3; and four legs 10*b* extended from both side portions of each of a front edge and a rear edge of the upper plate 10*a* and bent downward. The engagement piece 10*c* is provided on a tip end of each leg 10*b*. The engagement pieces 10*c* are caulked so as to engage with the lower faces of the engagement projections 12 to retain the cover 10 on the housing 2.

When the cover 10 is attached to the upper part of the housing 2, one of the legs 10*b* attached on the rear side face 2*c* of the housing 2 comes in contact with the external fixed terminal 7*a* of the second contact member 7 so as to establish electric connection. The contact between the external fixed terminal 7*a* and the leg 10*b* is firmly retained by bending the engagement piece 10*c* of the leg 10*b* toward the housing 2 and caulking to engage with the engagement projection 12.

An inclined part 10*d* is formed by bending a substantial center part of the upper part of the upper plate 10*a* toward the inside of the space 3 of the housing 2 by about 45 degrees. The inclined part 10*d* is so configured as to abut against the abutment part 9*d* of the actuator 9*b* to bias the actuator 9*b* in a direction pressing the movable contact 13. When the cover 10 is attached to the upper part of the housing 2, the inclined part 10*d* is located within the gap 15. When the pressed part 9*a* is laterally (from front side) pressed, the abutment part 9*d* of the actuator 9*b* comes in contact with the inclined part 10*d* so that the abutment part 9*d* is guided in a direction that the movable contact 13 is pressed (downward perpendicular to the direction that the part 9*a* is pressed). Accordingly, the movable contact 13 is pressed downward and cones in contact with the fixed contacts 5*a* and 6*a*.

In order to assemble the push switch 1, the movable contact 13, the protective sheet 14 and the operating member 9 are housed within the space 3 of the housing 2 in this order. Then, the cover 10 is attached to the upper part of the housing 2. After that, the engagement pieces 10*c* of the legs 10*b* are respectively caulked to engage with the lower faces of the engagement projections 12.

Figure 5:
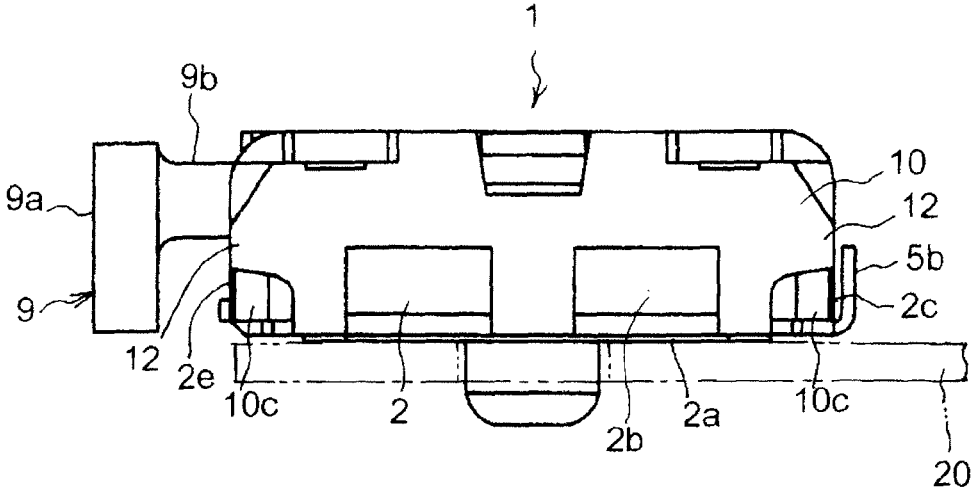
FIG. 5 is a side view of the push switch.
Figure 6:
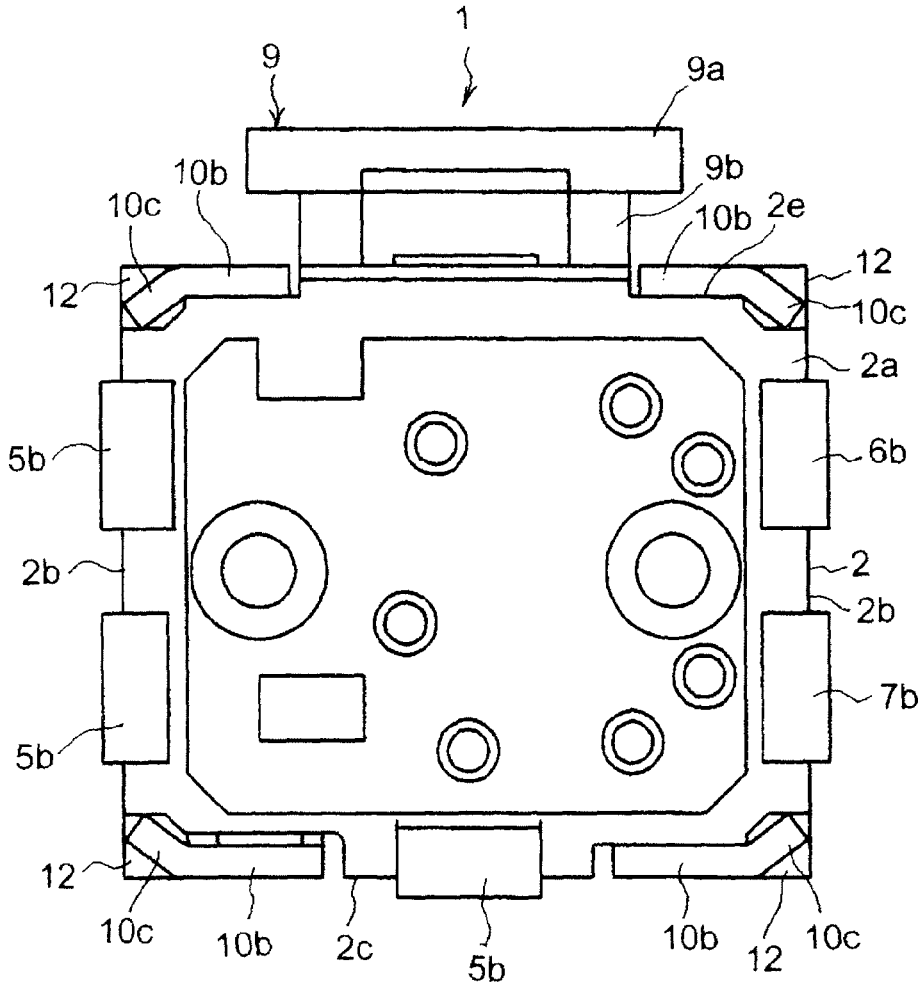
FIG. 6 is a bottom view of the push switch.

When the push switch 1 is mounted on the printed circuit board 20, as shown in FIG. 5, the operating member 9 is projected forward from the printed circuit board 20, and the lead terminals 5*b*, 6*b* and 7*b* are soldered with associated wiring parts. In this condition, the second contact member 7 is connected to a wiring part of the earth circuit on the printed circuit board 20 by way of the lead terminal 7*b*. Also the cover 10 is connected to the wiring part of the earth circuit by way of the second contact member 7.

There will be described how to operate the above-described push switch 1 with reference to FIG. 2.

First, under an initial condition shown by dashed chain lines, the abutment part 9*d* of the operating member 9*b* is in contact with the upper face of the top part of the dome-shaped movable contact 13 across the protecting sheet 14. In accordance with a synergism of elastic urging force of the movable contact 13 directed upward and the inclined face of the inclined part 10*d*, the operating member 9 is urged leftward in this figure (in an opposite direction to the direction that the pressed part 9*a* is pressed), thereby the pressed part 9*a* is projected outward (forward) from the housing 2. Incidentally, the outer peripheral portion of the movable contact 13 is in contact with the fixed contact 5*a* but the lower face of the top part of the dome-shaped movable contact 13 is away from the fixed terminal 6*a*, so that the push switch 1 is placed in the turn-off state.

From this state, when the pressed part 9*a* is pressed rightward in this figure, the abutment part 9*d* of the operating member 9*b* is guided downward (perpendicular to the direction that the pressed part 9*a* is pressed) along the inclined part 10*d* of the cover 10, and presses the upper face of the top part of the dome-shaped movable contact 13 through the protecting sheet 14. Accordingly, the movable contact 13 is moved downward and the lower face of the top part thereof comes into contact with the fixed contact 6*a*. As a result, the fixed contacts 5*a* and 6*a* are electrically connected, and the push switch 1 is placed in the turn-of state.

When the operating member 9 is pushed into the space 3 of the housing 2 and the fixed contacts 5*a* and 6*a* are electrically connected, the rear face of the pressed part 9*a* comes in contact with the legs 10*b* and the pressed part 9*a* covers at least parts of the legs 10*b* in order to prevent the legs 10*b* from being deformed forward thereby the engagement pieces 10*c* are disengaged from the engagement projections 12.

From the state, when the pressing against to the pressed part 9*a* is canceled, the movable contact 13 moves upward due to the own elastic restoration force and the push switch 1 is placed in the turn-off state. In accordance with the urging force generated by the restoring action, the abutment part 9*d* of the actuator 9*b* is guided leftward in this figure (the opposite direction to the direction that the pressed part 9*a* is pressed) along the inclined part 10*d*, so that the pressed part 9*a* moves forward and returns to the original condition.

When the finger of a person who operates the push switch 1 mounted on the printed circuit board 20 installed in an electric apparatus pushes a front face of the pressed part 9*a*, static electricity carried by the person may be of the operator is supplied to the operating member 9 through the finger. However, the supplied static electricity is transferred to the earth circuit on the printed circuit board 20 by way of the cover 10 and the second contact member 7.

In this embodiment, since the second contact member 7 is integrally molded with the housing 2 together with the first contact members 5 and 6, flux can be blocked by molded parts when the lead terminals 5*b*, 6*b* and 7*b* are soldered on the wiring parts on the printed circuit board 20.

The external fixed terminal 7*a* of the second contact member 7 is led out to the rear side face 2*c* of the housing 2 which intersects with the side faces 2*b* to which the lead terminal 7*b* of the second contact member 7 and the lead terminals 5*b* and 6*b* of the first contact members 5 and 6 are led out. The leg 10*b* of the cover 10 is brought into contact with the external fixed terminal 7*a* to secure an earthing path. The cover 10 is sufficiently away from the parts where the lead terminals 5*b*, 6*b* and 7*b* are respectively subjected to soldering. According to this configuration, the flux never enters a gap between the housing 2 and the cover 10.

Since the lead terminal 7*b* of the second contact member 7 is led out from the lower face 2*a* of the housing 2, the height difference with respect to the lead terminals 5*b* and 6*b* of the first contact members 5 and 6 can be reduced. Accordingly, the coplanarity among the lead terminals can be attained while meeting with the downsizing requirement.

Since the engagement pieces 10*c* of the cover 10 are caulked to engage with the lower faces of the engaging projections 12, the force for operating the operating member 9 can be received also by the lower faces of the engaging projections 12. Accordingly, not only the cover 10 can be firmly retained on the housing 2 against the force which would peel off the cover 10 from the housing 2, but the also the contact force between the cover 10 and the external fixed terminal 7*a* can be increased.

It is to be noted that although the above described embodiment is a preferable embodiment of the invention, the invention is not limited to this embodiment, but various modifications can be made within a scope not deviating from a gist of the invention.

The present invention is applicable to a switch-type electronic device other than the push switch and an electronic device other than the switch-type electronic device as long as it is adapted to be mounted on a circuit board by soldering.

The material of the housing 2 is not limited to resin as long as it is insulative. The material of cover 10, the first contact members 5, 6 and the second contact member 7 is not limited to metal as long as they are conductive.

The lead terminal 7*b* may not be exposed at one of the opposite side face 2*b* but may be exposed at the front side face 2*e*.

What is claimed is:

1. An electronic device adapted to be mounted on a circuit board, comprising:

a housing, made of an insulative material and having a first face adapted to oppose the circuit board, a second face and a third face respectively intersecting with the first face;

a cover, covering a part of the housing and made of a conductive material; and an earth contact member, made of a conductive material and integrally molded with the housing, the earth contact member having:

a first terminal, wrapping around from the first face along the second face of said housing, and adapted to be soldered on an earth circuit on the circuit board; and a second terminal, disposed on the third face of said housing and being in contact with the cover.

2. The electronic device as set forth in claim 1, wherein:

the third face of the housing is formed with a projection;

the cover has a first part disposed in a side opposite to the first face of the housing, a second part extending from the first part, and a third part extending from the second part and engaged with the projection; and the second part of the cover is in contact with the second terminal of the earth contact member.

3. A switch-type electronic device adapted to be mounted on a circuit board, comprising:

a housing, made of an insulative material and having a first face adapted to oppose the circuit board, a second face and a third face respectively intersecting with the first face;

a cover, covering a part of the housing and made of a conductive material;

an operating member, having a first part disposed in the housing and a second part disposed outside the housing and adapted to be operated by a user;

a first contact member, disposed in the housing and made of a conductive member, the first contact member configured to be actuated by the first part of the operating member when the second part of the operating member is operated by the user;

a plurality of second contact members, each of which is made of a conductive material and integrally molded with the housing, each of which is configured to switchingly comes in contact with the first contact member when the first contact member is actuated by the operating member, and each of which has a terminal extending from the first face to one of the second face and the third face; and an earth contact member, made of a conductive material and integrally molded with the housing, the earth contact member having:

a first terminal, wrapping around from the first face along the second face of said housing, and adapted to be soldered on an earth circuit on the circuit board; and a second terminal, disposed on the third face of said housing and being in contact with the cover.

4. The switch-type electronic device as set forth in claim 3, wherein:

the third face of the housing is formed with a projection;

the cover has a first part disposed in a side opposite to the first face of the housing, a second part extending from the first part, and a third part extending from the second part and engaged with the projection; and the second part of the cover is in contact with the second terminal of the earth contact member.

5. A push switch adapted to be mounted on a circuit board, comprising:

a housing, made of an insulative material and having a first face adapted to oppose the circuit board, a second face and a third face respectively intersecting with the first face;

a cover, covering a part of the housing and made of a conductive material;

an operating member, having a first part disposed in the housing and a second part disposed outside the housing and adapted to be operated by a user;

a movable contact member, disposed in the housing and made of a conductive member, the movable contact member configured to be actuated by the first part the operating member when the second part of the operating member is pushed by the user;

a first fixed contact member, made of a conductive material and integrally molded with the housing, the first fixed contact member having a terminal extending from the first face to one of the second face and the third face;

a second fixed contact member, made of a conductive material and integrally molded with the housing, the second fixed contact member having a terminal extending from the first face to one of the second face and the third face, and configured to be electrically connected to the first fixed contact member by way of the movable contact member when the movable contact member is actuated by the operating member; and an earth contact member, made of a conductive material and integrally molded with the housing, the earth contact member having:

a first terminal, wrapping around extending from the first face along the second face of said housing, and adapted to be soldered on an earth circuit on the circuit board; and a second terminal, disposed on the third face of said housing and being in contact with the cover.

6. The push switch as set forth in claim 5, wherein:

the third face of the housing is formed with a projection;

the cover has a first part disposed in a side opposite to the first face of the housing, a second part extending from the first part, and a third part extending from the second part and engaged with the projection; and the second part of the cover is in contact with the second terminal of the earth contact member.

* * * * *